US008054252B2

(12) United States Patent
Tada et al.

(10) Patent No.: US 8,054,252 B2
(45) Date of Patent: Nov. 8, 2011

(54) LIGHT-EMITTING DISPLAY DEVICE, ELECTRONIC APPARATUS, BURN-IN CORRECTION DEVICE, AND PROGRAM

(75) Inventors: Mitsuru Tada, Kanagawa (JP); Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 1036 days.

(21) Appl. No.: 11/714,888

(22) Filed: Mar. 7, 2007

(65) Prior Publication Data

US 2007/0236431 A1 Oct. 11, 2007

(30) Foreign Application Priority Data

Mar. 8, 2006 (JP) ..... P2006-062132

(51) Int. Cl.
*G09G 3/30* (2006.01)

(52) U.S. Cl. ..... 345/77; 345/76

(58) Field of Classification Search ..... 345/77
See application file for complete search history.

(56) References Cited

U.S. PATENT DOCUMENTS 6,456,016 B1 * 9/2002 Sundahl et al. ..... 315/291
6,498,592 B1 * 12/2002 Matthies ..... 345/1.1
6,710,548 B2 * 3/2004 Kimura ..... 315/169.3
6,897,855 B1 * 5/2005 Matthies et al. ..... 345/204
2003/0071821 A1 * 4/2003 Sundahl et al. ..... 345/589
2004/0070558 A1 * 4/2004 Cok et al. ..... 345/76
2004/0165064 A1 * 8/2004 Weitbruch et al. ..... 348/173
2004/0233125 A1 * 11/2004 Tanghe et al. ..... 345/1.3
2005/0030267 A1 * 2/2005 Tanghe et al. ..... 345/82
2005/0052369 A1 * 3/2005 Tada ..... 345/76
2005/0179628 A1 * 8/2005 Kimura ..... 345/77
2005/0280766 A1 * 12/2005 Johnson et al. ..... 349/167
2005/0285822 A1 * 12/2005 Reddy et al. ..... 345/76
2006/0077136 A1 * 4/2006 Cok ..... 345/76

FOREIGN PATENT DOCUMENTS

JP 2000-132139 5/2000
JP 2001-175221 6/2001
JP 2003-228329 8/2003

* cited by examiner

*Primary Examiner* — Richard Hjerpe
*Assistant Examiner* — Dorothy Harris
(74) *Attorney, Agent, or Firm* — Rader, Fishman & Grauer PLLC

(57) ABSTRACT

A light-emitting display device is disclosed. The display includes: a display panel having a plurality of light-emitting elements disposed on a substrate in a matrix; a deterioration amount difference calculation section; a correction amount calculation section; a deterioration amount difference correction section; a gamma conversion section; an actual deterioration amount calculation section; and an estimation error detection section.

12 Claims, 13 Drawing Sheets

FIG. 3

| GRADATION VALUE | CONVERSION | DETERIORATION RATE | LIGHT EMITTING PERIOD | DETERIORATION AMOUNT |
|---|---|---|---|---|
| 0 | ⇕ | $X_0$ | t | $R_0 = X_0 \times t$ |
| 1 | ⇕ | $X_1$ | | $R_1 = X_1 \times t$ |
| ... | ⇕ | ... | | ... |
| 254 | ⇕ | $X_{254}$ | | $R_{254} = X_{254} \times t$ |
| 255 | ⇕ | $X_{255}$ | | $R_{255} = X_{255} \times t$ |

WITH 8 BIT GRADATION INFORMATION

FIG. 4

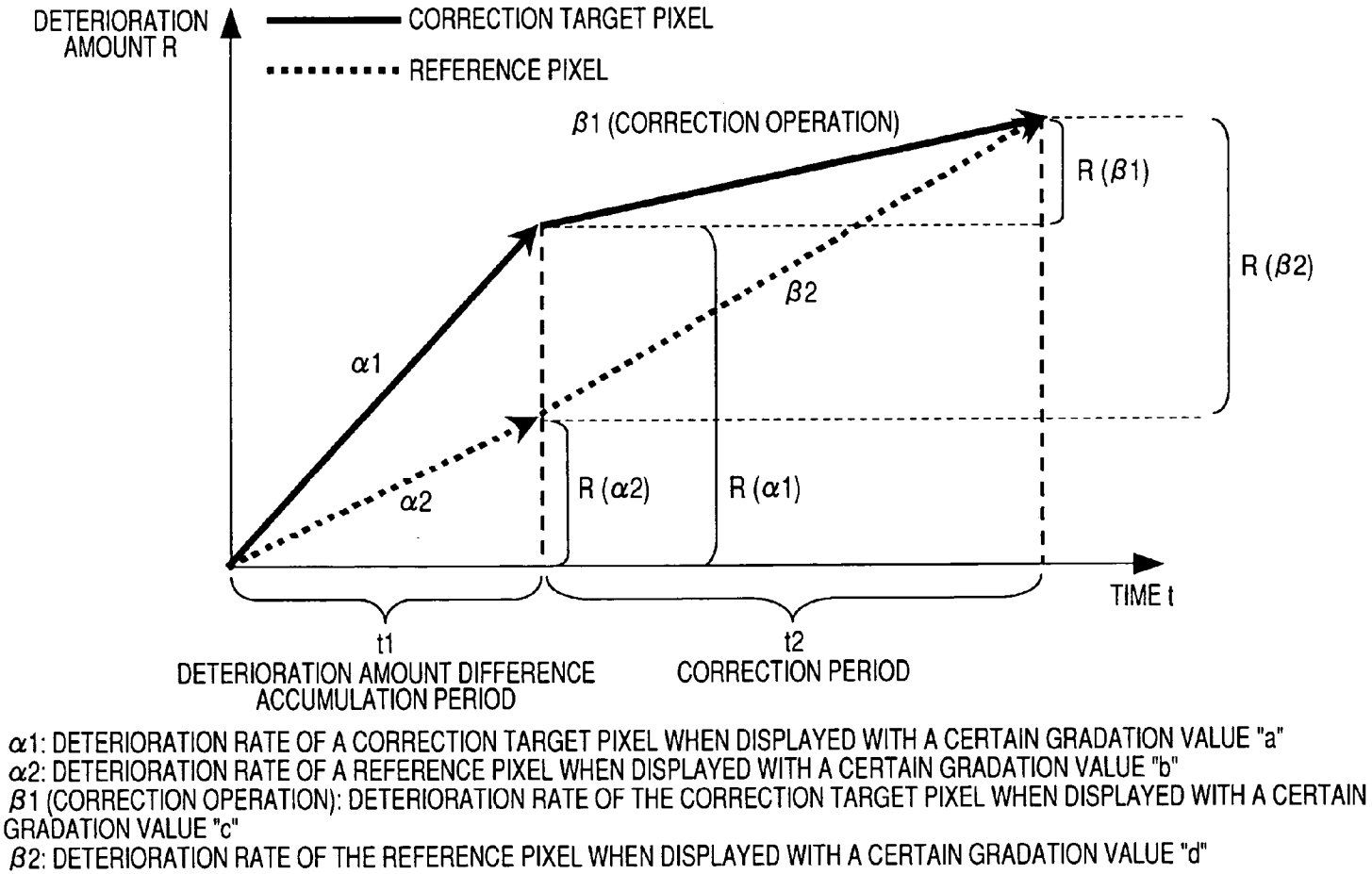

α1: DETERIORATION RATE OF A CORRECTION TARGET PIXEL WHEN DISPLAYED WITH A CERTAIN GRADATION VALUE "a"
α2: DETERIORATION RATE OF A REFERENCE PIXEL WHEN DISPLAYED WITH A CERTAIN GRADATION VALUE "b"
β1 (CORRECTION OPERATION): DETERIORATION RATE OF THE CORRECTION TARGET PIXEL WHEN DISPLAYED WITH A CERTAIN GRADATION VALUE "c"
β2: DETERIORATION RATE OF THE REFERENCE PIXEL WHEN DISPLAYED WITH A CERTAIN GRADATION VALUE "d"

FIG. 6

| | γ-TABLE OUTPUT GRADATION | | |
|---|---|---|---|
| INPUT GRADATION | D = -50 | ... | D = +50 |
| 0 | 0 | 0 | 0 |
| 1 | 3 | 2 | 1 |
| ... | ... | ... | ... |
| 254 | 1022 | 1020 | 990 |
| 255 | 1023 | 1023 | 1023 |

LIGHT-EMITTING DISPLAY DEVICE, ELECTRONIC APPARATUS, BURN-IN CORRECTION DEVICE, AND PROGRAM

CROSS REFERENCES TO RELATED APPLICATIONS

The present invention contains subject matter related to Japanese Patent Application JP 2006-062132 filed in the Japan Patent Office on Mar. 8, 2006, the entire contents of which are incorporated herein by reference.

BACKGROUND OF THE INVENTION

1. Technical Field

An embodiment of the invention relates to a burn-in correction technology for a light-emitting display panel.

It should be noted that the invention proposed by the inventors includes aspects of a light-emitting display device, an electronic apparatus, a burn-in correction device, and a program.

2. Related Art

Flat panel displays are widely prevalent in products such as computer displays, mobile terminals, and television receivers. Although liquid crystal display panels are widely adopted now, narrow view angles and slow responses are still pointed out continuously.

On the other hand, organic EL displays composed of light-emitting elements are capable of achieving thin shapes without backlights, high luminance, and high contrast, in addition to overcoming the problems of view angles and responses. Therefore, organic EL displays are expected to be next generation display devices superseding liquid crystal displays.

Incidentally, organic EL devices or, other light-emitting devices have their characteristics deteriorated in accordance with the light-emitting amount or the amount of light-emitting period.

On the other hand, contents of images displayed on light-emitting display devices are not uniform. Therefore, deterioration of a part of the light-emitting elements is easily advanced. For example, deterioration in luminance advances faster in a time display area (a static display area) than in other display areas (moving image display areas).

The luminance of the light-emitting element with advanced deterioration is lowered in comparison with the luminance thereof in other display areas. This phenomenon is generally called "burn-in." Hereinafter, the deterioration of a part of the light-emitting elements is described as "burn-in."

Presently, there are various methods as measures for remediating the "burn-in" phenomenon.

As related art documents, there can be cited JP-A-2003-228329, JP-A-2000-132139, and JP-A-2001-175221.

SUMMARY

In order to correct the burn-in phenomenon, there are some cases of performing correction of the burn-in phenomenon in parallel with displaying pictures. In these cases, it is required to estimate the display content in advance to correct the deterioration amount difference for every pixel without an error.

However, the display content keeps changing. Therefore, the correction amount is just an estimated value, and there is a possibility that an accurate correction operation is not necessarily ensured, depending on the actual display content.

Therefore, the inventors propose a correction technology combining the following functions as a device for correcting burn-in of a display panel having a plurality of light-emitting elements disposed on a substrate in a matrix.

a. A deterioration amount difference calculation section for calculating a deterioration amount difference caused between a correction target pixel and a reference pixel in a first light-emitting period;

b. A correction amount calculation section for calculating a correction amount necessary to eliminate the calculated deterioration amount difference in a second light-emitting period for each correction target pixel in accordance with an estimated deterioration amount of the reference pixel;

c. A deterioration amount difference correction section for correcting a gradation value of a corresponding pixel with the calculated correction amount;

d. A gamma conversion section for performing a gamma conversion on the gradation value corrected by the deterioration amount difference correction section to supply the display panel with the gradation value;

e. An actual deterioration amount calculation section for inputting the gradation value supplied from the gamma conversion section to the display panel to calculate an actual deterioration amount corresponding to the reference pixel; and f. An estimation error detection section for detecting an error amount between the estimated deterioration amount and the actual deterioration amount calculated with respect to the reference pixel to update an input-output relation used by the gamma conversion section so as to eliminate the error amount.

According to the correction technology proposed by the inventors, if an error is caused between the estimated deterioration amount and the actual deterioration amount of the reference pixel, the corrected gradation value is gamma converted so as to eliminate the error amount. In other words, according to the correction technology proposed by the inventors, the gamma conversion is performed on the gradation values of all the pixels so that the actual deterioration amount becomes equal to the estimated deterioration amount of the reference pixel estimated when calculating the correction value. As a result, the premise conditions of the correction operation are satisfied, and thus an accurate correction operation can be ensured.

BRIEF DESCRIPTION OF THE DRAWINGS

FIG. 3 is a diagram showing an example of a conversion table for storing a relationship between gradation values and corresponding deterioration rates.

FIG. 4 is a diagram for explaining the principle of a correction process of the burn-in phenomenon.

FIG. 6 is a diagram showing a relationship between error amounts and corresponding gamma curves.

DESCRIPTION OF THE EMBODIMENTS

Hereinafter, a correction method of the burn-in phenomenon adopting an engineering method according to an embodiment of the invention will be explained.

It should be noted that technologies in the art known or well known to the public are adopted to portions not specifically shown or described in the present specification.

Further, embodiments described below are each just one embodiment of the invention, and the invention is not limited to these embodiments.

A. Example of Application to Organic EL Display

A-1. Overall Configuration

Figure 1:
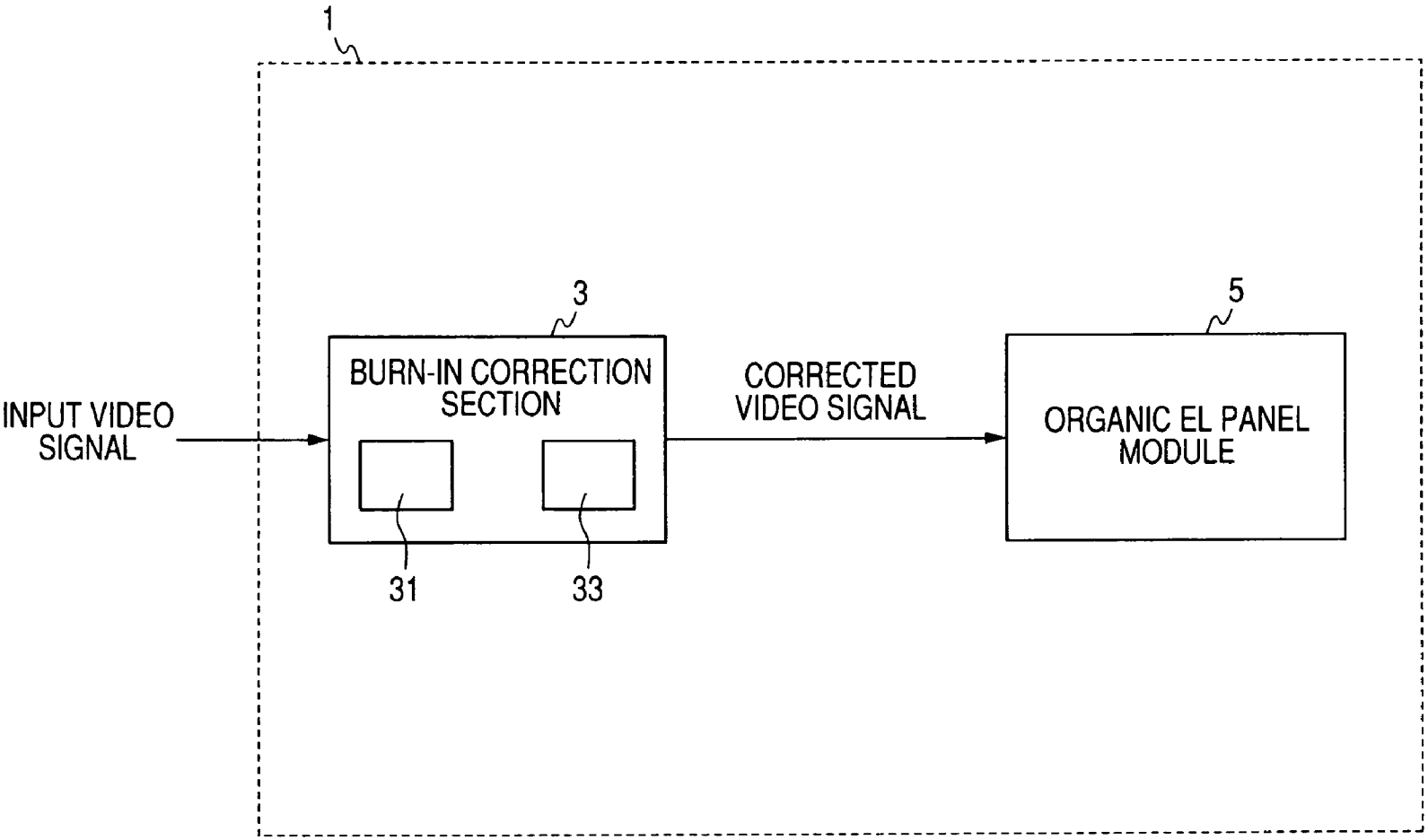
FIG. 1 is a diagram showing an example of a schematic configuration of an organic EL display.

FIG. 1 shows a configuration example of an organic EL display. The organic EL display is an example of "a light-emitting display device" in the appended claims.

The organic EL display 1 is composed of a burn-in correction section 3 and an organic EL panel module 5.

The burn-in correction section 3 is a processing device for performing two processes as an estimated correction section 31 and an estimation error correction section 33. The burn-in correction section 3, corresponds to "a burn-in correction device" in the appended claims. Out of these sections, the estimated correction section 31 is a processing device for correcting an input video signal so that a deterioration amount difference of each pixel from a reference pixel is eliminated within a correction period. Further, the estimation error correction section 33 is a processing device for correcting the input video signal (a gradation value), on which the estimated correction is performed, so that the error caused between an actual deterioration amount and the estimated deterioration amount is eliminated.

The organic EL panel module 5 is a display device using organic EL elements as the light-emitting elements.

The organic EL panel module 5 is composed of an effective display area and a drive circuit (a data driver, a scan driver, etc.) therefor.

The effective display area is provided with the organic EL elements arranged in a matrix. It should be noted that the luminescent color is assumed to include three colors, R (red), G (green), and B (blue). A pixel for display is formed of a group of these three color elements.

A-2. Inside Configuration of Burn-In Correction Section 3

Figure 2:
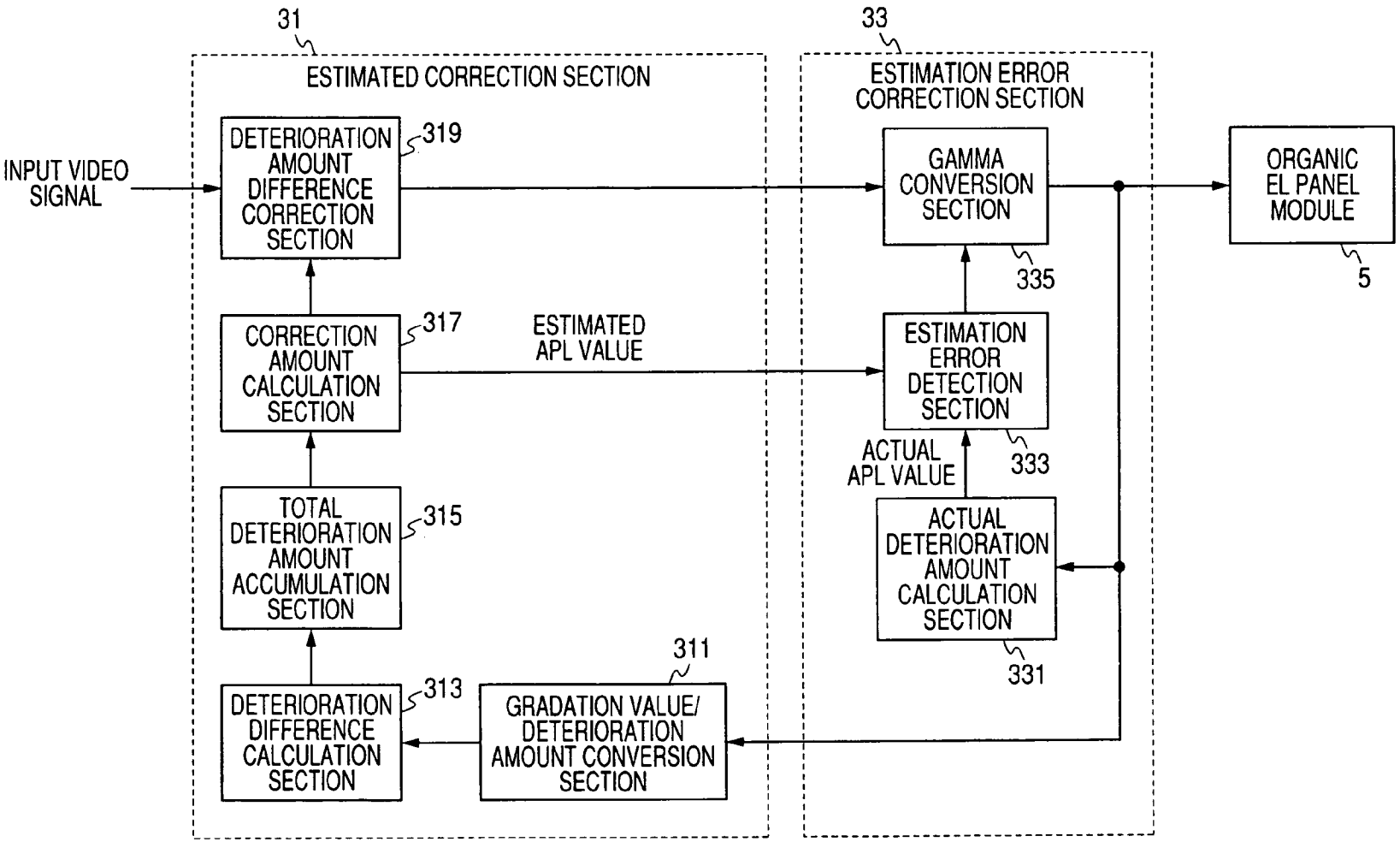
FIG. 2 is a diagram showing an example of an inside configuration of a burn-in correction section.

FIG. 2 shows the inside configuration of the burn-in correction section 3.

a. Estimated Correction Section 31

The estimated correction section 31 is composed of a gradation value/deterioration amount conversion section 311, a deterioration amount difference calculation section 313, a total deterioration amount accumulation section 315, a correction amount calculation section 317, and a deterioration amount difference correction section 319.

The gradation value/deterioration amount conversion section 311 is a processing device for converting the video signal (gradation value) actually supplied to the organic EL panel module 5 into a deterioration amount parameter. The reason for converting the gradation value into the deterioration amount parameter is that the deterioration amount of the organic EL elements presently put into practical use is not necessarily proportional to the gradation value.

Therefore, the gradation value/deterioration amount conversion section 311 is provided for converting the gradation value of each of the pixels corresponding to each of the luminescent colors into the deterioration amount. In the present configuration example, the relationship between the gradation values and the deterioration amounts of the organic EL elements is obtained by an experiment, and the relationship data therebetween is stored as a look-up table.

FIG. 3 shows an example of the gradation value/deterioration amount conversion table. In the case of the gradation value/deterioration amount conversion table shown in FIG. 3, a deterioration rate and a deterioration amount are stored in relationship to the gradation value. The deterioration rate denotes the deterioration amount per unit time. Therefore, the deterioration amount can be obtained by multiplying the deterioration rate by a light-emitting period t.

The deterioration amount difference calculation section 313 is a processing device for calculating the deterioration difference between each of the pixels (correction target pixels) forming the effective display area and the reference pixel. The reference pixel is used as the correction reference when performing the burn-in correction operation. In the case of the present configuration example, it is assumed to be a pixel which emits light with an average gradation value of all the pixels forming the effective display area. The reference pixel can be prepared actually on the display panel, or can be prepared virtually by signal processing.

The deterioration amount difference calculation section 313 subtracts the deterioration amount of the reference pixel from the deterioration amount of the correction target pixel to obtain the difference value as the deterioration amount difference.

For example, assuming that the light-emitting period is t1, the deterioration rate of the correction target pixel is $\alpha 1$, and the deterioration rate of the reference pixel is $\alpha 2$, the deterioration amount difference Y can be obtained by the following formula.

$$Y=(\alpha 1-\alpha 2)\cdot t1$$

It should be noted that the positive deterioration amount difference value, denotes that the deterioration of the correction target pixel leads that of the reference pixel. On the contrary, the negative deterioration amount difference value denotes that the deterioration of the correction target pixel lags behind that of the reference pixel.

The total deterioration amount accumulation section 315 is a storage area or a storage device for storing an accumulated value of the deterioration amount of the reference pixel and an accumulated value of the deterioration amount difference of each of the pixels (the correction target pixels). For example, a semiconductor memory, a magnetic storage medium such as a hard disc drive, or an optical storage medium such as an optical disc can be used therefor.

The correction amount calculation section 317 is a processing device for calculating the correction amount for eliminating the deterioration amount difference calculated for each of the pixels within a future period (a correction period) based on the estimated deterioration amount of the reference pixel.

FIG. 4 shows the calculation principle of the correction amount by the correction amount calculation section 317. FIG. 4 shows conditions for making the deterioration amount difference caused in the previous period t1 be zero within the correction period t2. It should be noted that in FIG. 4, the transition of the deterioration amount corresponding to the reference pixel is illustrated with a dashed line while the transition of the deterioration amount corresponding to the correction target pixel is illustrated with a solid line.

Assuming that the estimated deterioration rate in the correction period t2 is B2, the estimated deterioration rate B1 of the correction target pixel is expressed as the following formulas using the deterioration amount difference Y caused in the previous period t1.

$$Y=(\alpha 1-\alpha 2)\cdot t1$$

$$\beta 1=\beta 2-Y/t2=\beta 2-(\alpha 1-\alpha 2)\cdot t1/t2$$

The correction amount calculation section 317 refers to the gradation value/deterioration amount conversion table (see FIG. 3) to obtain the gradation value corresponding to the calculated deterioration rate β1.

It should be noted that this gradation value is a gradation value required for the corrected video signal. The correction amount calculation section 317 subtracts the required gradation value (corresponding to β1) from the estimated gradation value of the correction target pixel so as to satisfy this gradation value, thus calculating the correction value for the correction target pixel.

For example, if the estimated gradation value is greater than the required gradation value, the correction value becomes a negative value. Further, if the estimated gradation value is smaller than the required gradation value, the correction value becomes a positive value.

The deterioration amount difference correction section 319 is a processing device for correcting the gradation value of the corresponding pixel with the calculated correction value. For example, the deterioration amount difference correction section 319 performs a process of adding the gradation value to the input video signal.

b. Estimation Error Correction Section 33

The estimation error correction section 33 is composed of an actual deterioration amount calculation section 331, an estimation error detection section 333, and a gamma conversion section 335.

The actual deterioration amount calculation section 331 is a processing device for inputting the gradation value supplied to the organic EL panel module 5 to calculate the actual deterioration amount corresponding to the reference pixel.

As described above, in the present configuration example, the actual deterioration amount corresponding to the reference pixel is given as the average gradation value of all of the pixels forming the effective display area. Specifically, the actual deterioration amount calculation section 331 performs a process for obtaining the average of the deterioration amount parameters corresponding to the gradation value of all of the pixels. The conversion into the deterioration parameters is performed using the gradation value/deterioration amount conversion table (see FIG. 3) described above. It should be noted that the average gradation value is obtained for every luminescent color.

The estimation error detection section 333 is a processing device for detecting the error amount of the calculated estimated deterioration amount from the actual deterioration amount for the reference pixel to update the input-output relation used by the gamma conversion section 335, so as to eliminate the error amount.

As described above, the estimated correction section 31 estimates the gradation value of the reference pixel in the correction period, thereby determining the correction value on the basis of this gradation value.

However, it is all just an estimation, and accordingly, there is a possibility that the gradation value of the reference pixel on which the calculation of the correction value is premised becomes different from the actual value depending on the content of an image to be input and displayed in real time. Specifically, the average luminance of the actual screen can be higher or lower than the estimated average luminance.

Therefore, the estimation error detection section 333 calculates the difference of the actual deterioration amount from the estimated deterioration amount with a sign.

The positive difference value denotes that the average luminance of the actual image is lower (darker) than that of the estimated image. On the contrary, the negative difference value denotes that the average luminance of the actual image is higher (brighter) than that of the estimated image.

Therefore, if it has been detected that the deterioration leads the estimated value, the estimation error detection section 333 changes the input-output relation of the gamma conversion section 335 so that the average luminance is lowered. Further, if it has been detected that the deterioration lags behind the estimated value, the estimation error detection section 333 changes the input-output relation of the gamma conversion section 335 so that the average luminance is increased.

Figure 5:
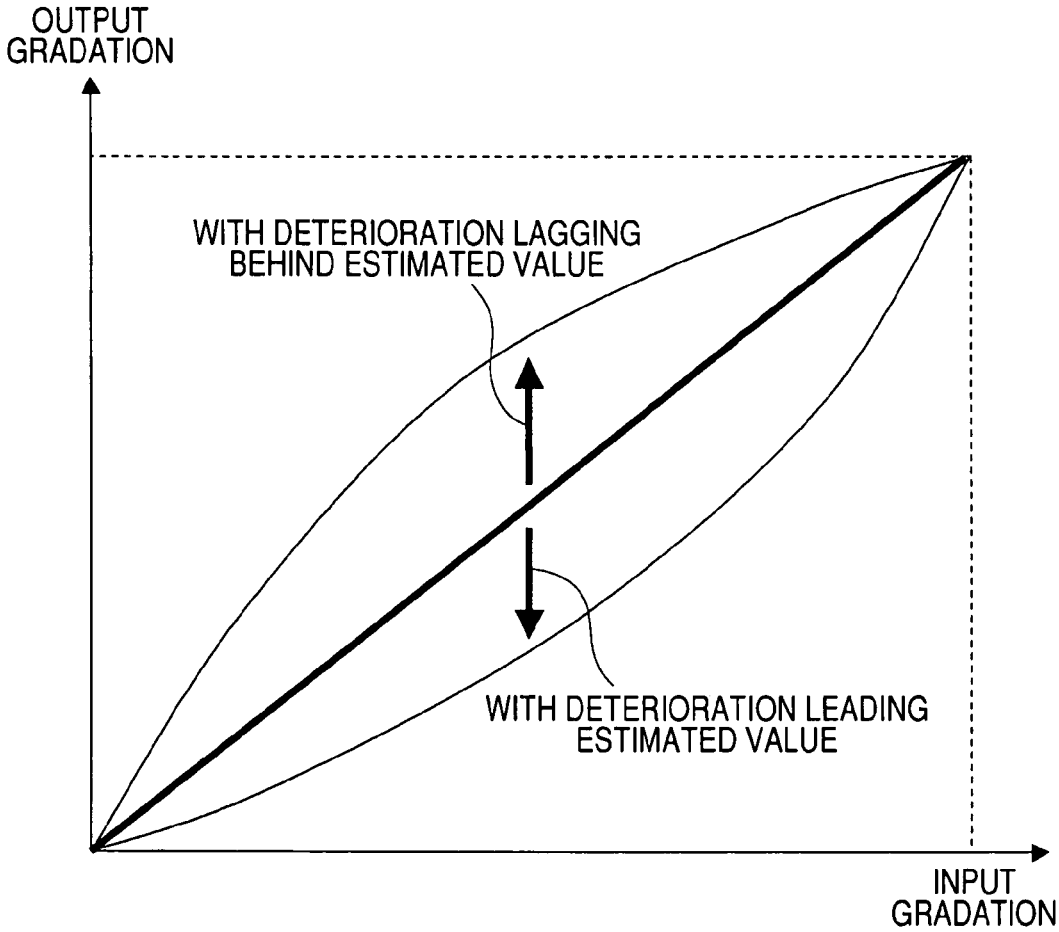
FIG. 5 is a diagram for explaining a principle of a correction process of an estimation error.

FIG. 5 shows an image of controlling the gamma curve (input-output relation). It should be noted that if no error exists between the estimated deterioration amount and the actual deterioration amount, the gamma curve becomes a linear curve denoted with the bold line in the drawing.

It should be noted here that the γ value for providing the gamma curve (defined by the following formula) in the following equation becomes a value greater or smaller than one as the error value increases.

$$y=x^{1/\gamma}$$

It should be noted that the γ value equals to one if the error value is 0 (zero).

The input-output relations of the gamma curve (conversion table) corresponding to the error amounts are stored separately in the estimation error detection section 333 for every error amount.

FIG. 6 shows an example of an aggregate of conversion tables stored in the estimation error detection section 333. In the case of FIG. 6, the error amount D is prepared in a range of the converted value of the deterioration amount from −50 to +50. Further, the gamma curve data (input-output data) for all of the gradation values corresponding to the error amount D are prepared.

Figure 7:
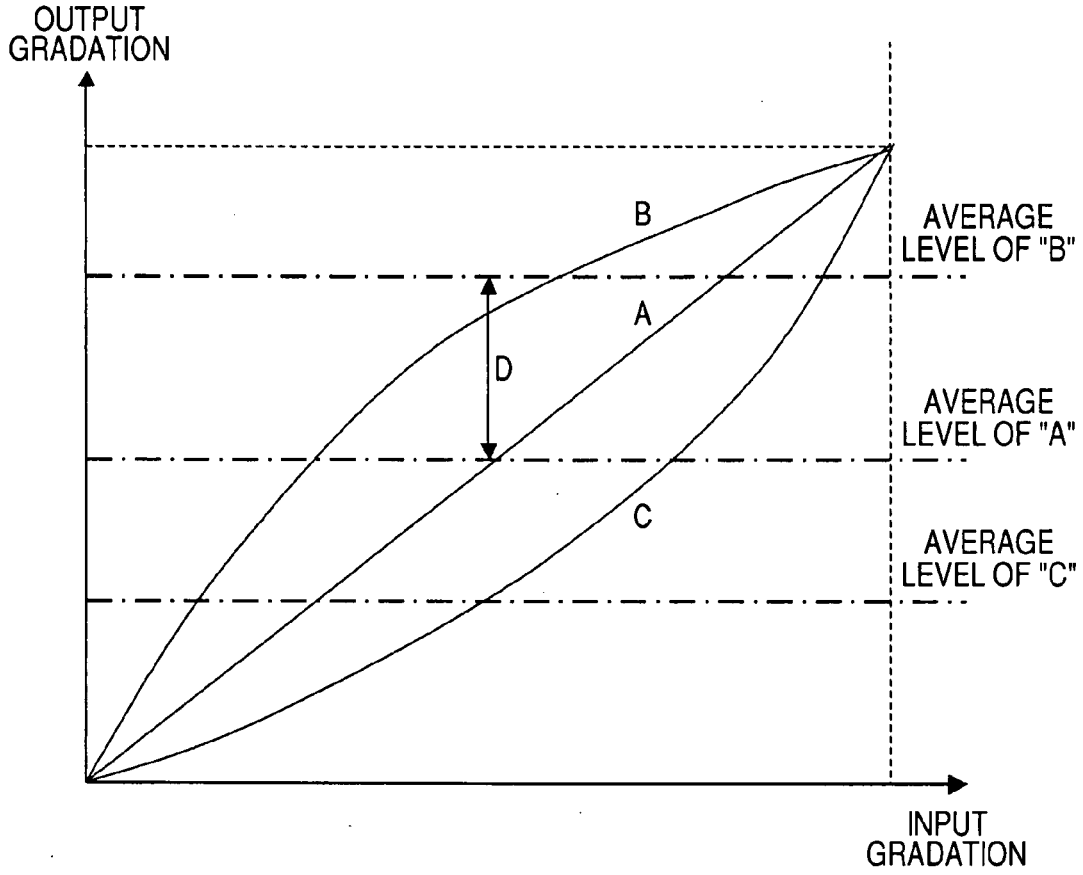
FIG. 7 is a diagram for explaining average luminance level differences among the gamma curves.

FIG. 7 shows a relationship between the average level of each of the gamma curves and the error amount D. The average level of each of the gamma curves corresponding to the error amount is set so that the difference from the average level of the gamma curve with the error amount of 0 (zero) becomes equal to the error amount D between the estimated deterioration amount and the actual deterioration amount.

However, a correction delay is caused in the actual system. Therefore, in the present configuration example, it is assumed that the gamma curve (input-output relation) having a greater difference in the average level than in the case of eliminating the actual error amount is made correspond thereto.

For example, a method of making the gamma curve B correspond to a smaller error amount than the actual error amount D between the estimated deterioration amount and the actual deterioration amount is adopted.

The gamma conversion section 335 is a processing device for performing the gamma conversion on the video signal (gradation value), which has already been corrected by the deterioration amount difference correction section 319, in accordance with the set gamma curve (input-output relation).

The modification of the gamma curve (input-output relation) is performed sequentially by the estimation-error detection section 333.

A-3. Correction Operation of Burn-In Phenomenon

Subsequently, the burn-in correction operation achieved by the estimated correction section 31 and the estimation error correction section 33 will be explained. Hereinafter, the correction operation of the estimated correction section 31 and the correction operation of the estimation error correction section 33 will be explained separately from each other.

a. Estimated Correction Operation

Figure 8:
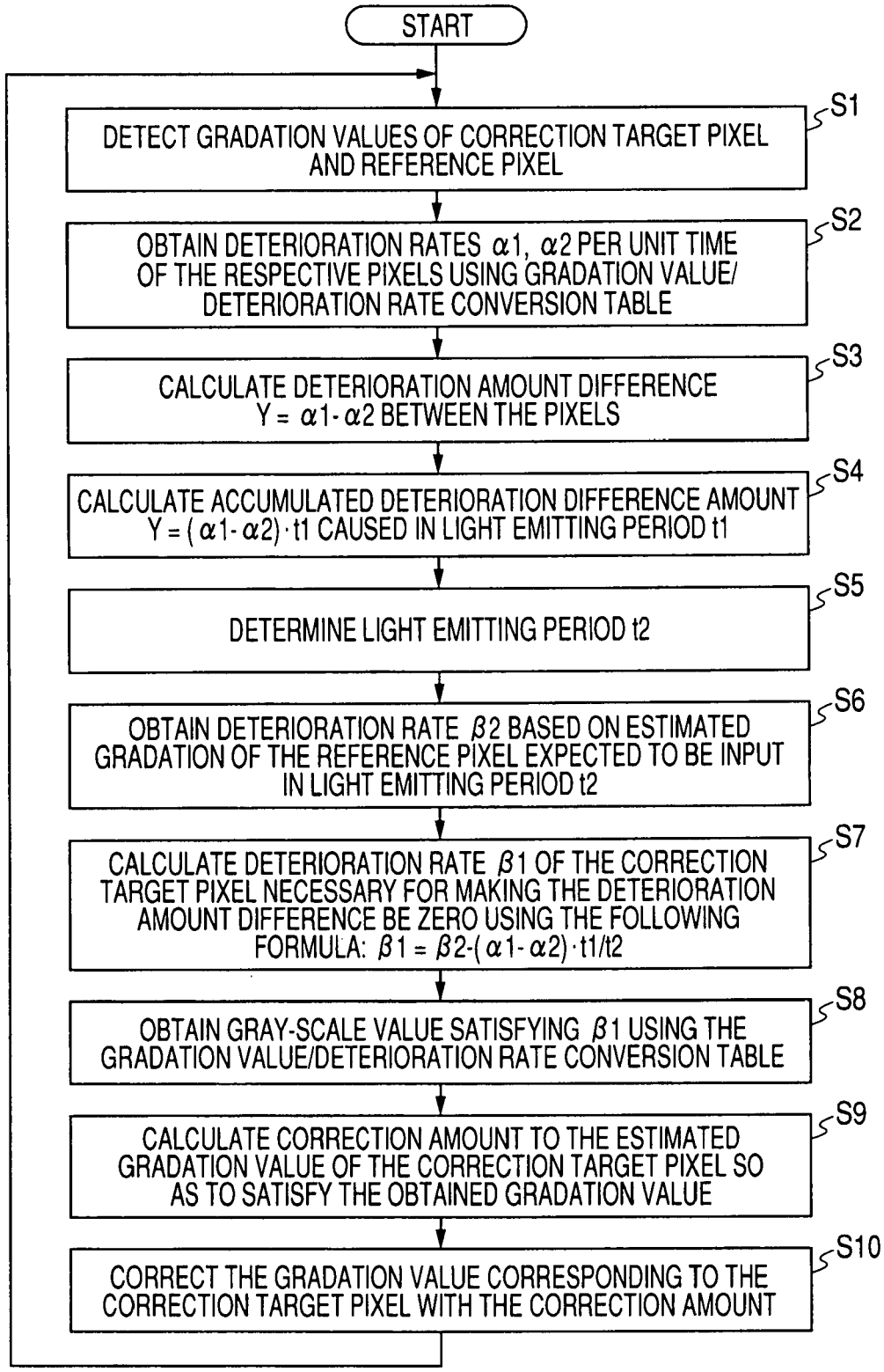
FIG. 8 is a chart showing a processing procedure of an estimated correction operation.

FIG. 8 shows an example of the processing procedure of the estimated correction operation. The estimated correction operation is performed by alternately repeating a period in which the deterioration amount difference between the pixels is accumulated and a period of correcting the accumulated deterioration amount difference.

Firstly, the gradation value of each of the correction target pixel and the reference pixel is detected in the gradation value/deterioration amount conversion section 311 (S1).

Then, the gradation value/deterioration amount conversion section 311 obtains the deterioration rates corresponding to each correction target pixel and reference pixel using the gradation value/deterioration amount conversion table shown in FIG. 3. Specifically, the deterioration rate $\alpha 1$ of the correction target pixel and the deterioration rate $\alpha 2$ of the reference pixel are separately obtained (S2). It should be noted that as the correction target pixel, all of the pixels forming the effective display area are designated sequentially or in parallel.

The deterioration amount difference calculation section 313 calculates the deterioration amount difference caused between the correction target pixel and the reference pixel (S3).

The calculated deterioration amount difference is accumulated cumulatively in the total deterioration amount accumulation section 315. At the end of the accumulation period t1, the total deterioration amount accumulation section 315 calculates the accumulated deterioration amount difference Y corresponding to each of the correction target pixels using the following formula (S4).

$$Y=(\alpha 1-\alpha 2)\cdot t1$$

Subsequently, the correction amount calculation section 317 determines the light-emitting period t2 as the correction period (S5). As the light-emitting period, any desired values can be set. However, a too short light-emitting period causes a large correction amount in the unit time, thus degrading the quality of the image. Therefore, it is preferable that the correction amount is set within the allowable range. For example, the light-emitting period t2 can be set equal to the accumulation period t1.

Then, the correction amount calculation section 317 obtains the deterioration rate $\beta 2$ in accordance with the estimated gradation value of the reference pixel expected to be input in the light-emitting period t2 (S6).

By obtaining the deterioration rate $\beta 2$, all of the values (the deterioration rates $\alpha 1$, $\alpha 2$, $\beta 2$, and the light-emitting periods t1, t2) necessary to calculate the deterioration rate $\beta 1$ of the correction target pixel are decided.

Then, the correction amount calculation section 317 obtains the deterioration rate $\beta 1$ necessary to eliminate the deterioration amount difference in accordance with the conditional equation for correction described above (S7). Specifically, the deterioration rate $\beta 1$ is calculated using the following formula.

$$\beta 1=\beta 2-(\alpha 1-\alpha 2)\cdot t1/t2$$

Further, the correction amount calculation section 317 obtains the gradation value corresponding to the obtained deterioration rate $\beta 1$ (S8).

Subsequently, the correction amount calculation section 317 calculates the correction amount for the estimated gradation value of the correction target pixel so as to satisfy the obtained gradation value (S9). Thus, the correction amount is determined relatively to the estimated gradation value.

The deterioration amount difference correction section 319 corrects the gradation value of the corresponding correction target pixel with the correction amount thus determined.

b. Estimation Error Correction Operation

An example of the processing procedure of the estimation error correction operation now will be explained.

If the gradation value as estimated by the estimated correction section 31 is given as the input video signal, the difference in the emission luminance between the reference pixel and each of the correction target pixels must become 0 (zero) at the end of the correction period t2, as described above.

Figure 9:
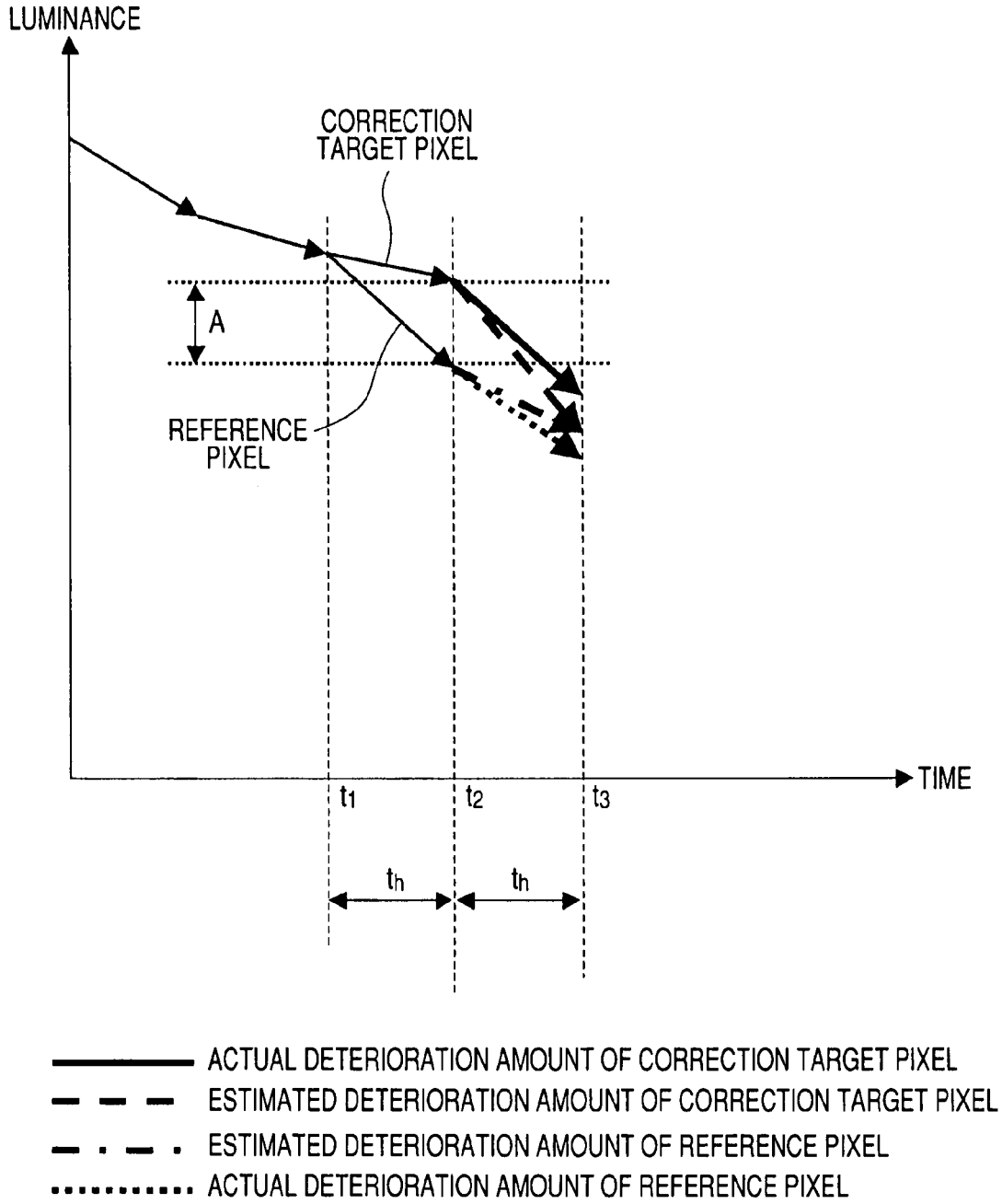
FIG. 9 is a diagram for explaining the transition of a deterioration amount caused when an estimation error correction is not performed.

FIG. 9 shows a conceptual diagram of the correction operation. In the case of FIG. 9, the emission luminance of the correction target pixel and the emission luminance of the reference pixel must become the same at the time point t3 as illustrated with the dashed line and the alternate long and short dash line.

However, as illustrated with the dot line and the solid line in FIG. 9, there is a possibility that the transition of the actual deterioration amount of the correction target pixel and the transition of the actual deterioration amount of the reference pixel will not converge at the time point t3.

This may be caused by a problem of low estimation accuracy, but at the same time, there is a limitation in estimating the content of the input video signal.

Therefore, the estimation error correction section 33 performs the following correction operation.

Figure 10:
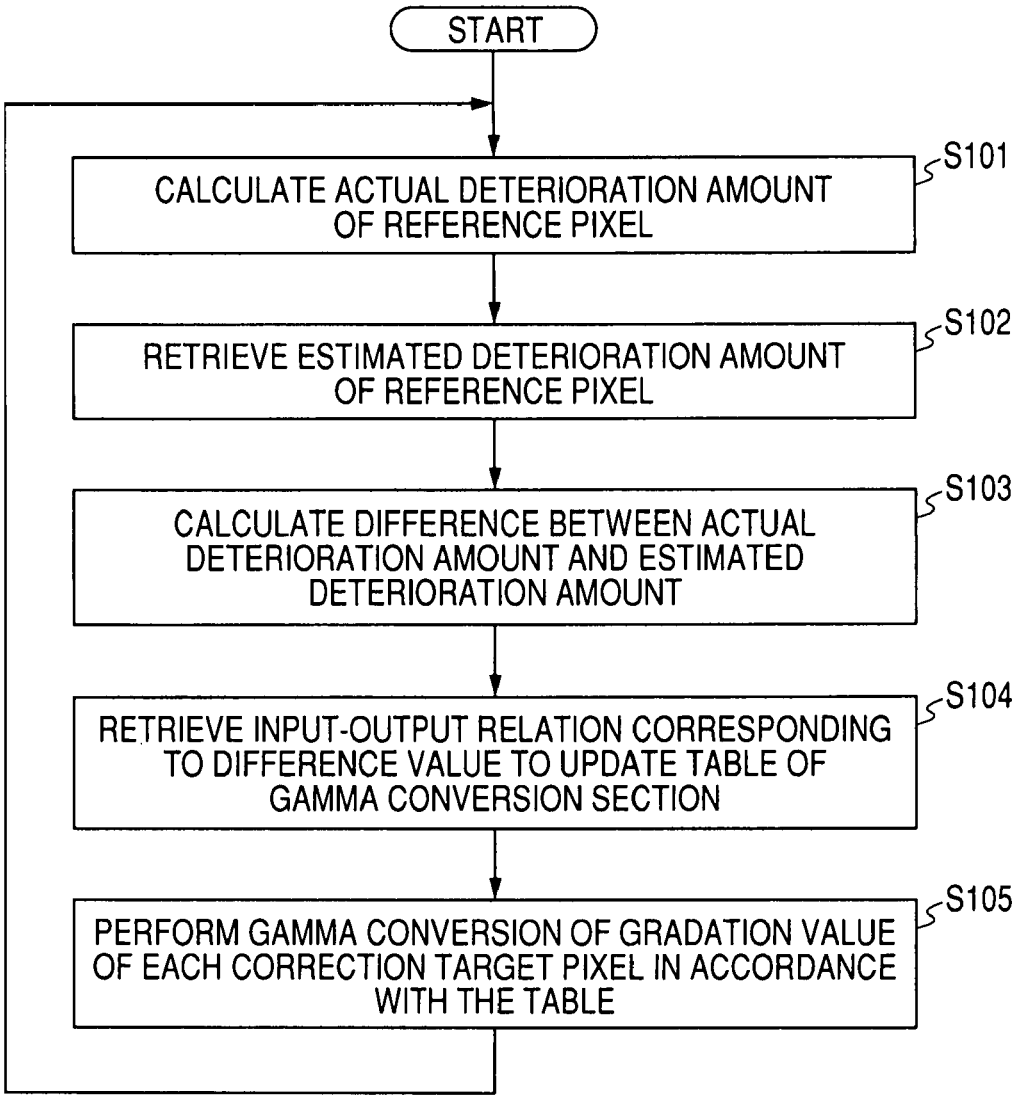
FIG. 10 is a chart showing a processing procedure of the estimation error correction operation.

FIG. 10 shows an example of the processing procedure of the estimation error correction operation.

Firstly, the actual deterioration amount calculation section 331 sequentially calculates the actual deterioration amount of the reference pixel (S101). Specifically, the average gradation value for each of the emission colors is calculated in each frame. The calculated actual deterioration amount is provided to the estimation error detection section 333.

Subsequently, the estimation error detection section 333 retrieves the deterioration amount (estimated deterioration amount) estimated in the correction operation by the correction amount calculation section 317 (S102).

Then, the estimation error detection section 333 calculates the difference between the estimated deterioration amount and the actual deterioration amount, namely the error amount (S103). The difference amount is obtained as a positive value or a negative value as described above, and it becomes an amount representing the amplitude of the error amount.

The estimation error detection section 333 retrieves the conversion table corresponding to the error amount and sets the conversion table in the gamma conversion section 335 (S104). It should be noted that the setting of the conversion table is performed continuously in real time.

The gamma conversion section 335 gamma-converts the gradation value of each of the correction target pixels with reference to the set conversion table and outputs the result to the organic EL display module 5.

As a result of this gamma conversion, the gradation value is converted so as to increase the average luminance of the whole screen if the actual deterioration amount is smaller than the estimated deterioration amount, or the gradation value is converted so as to lower the average luminance of the whole screen if the actual deterioration amount is greater than the estimated deterioration amount.

It is obvious that the adjustment amount of the average luminance is optimized in accordance with the error amount between the actual deterioration amount and the estimated deterioration amount.

As a result, the average luminance of the image displayed on the organic EL display satisfies the conditions estimated in the burn-in correction. Therefore, the premise of the correction can be restored, and thus the consistently appropriate corrective effect can be expected.

Figure 11:
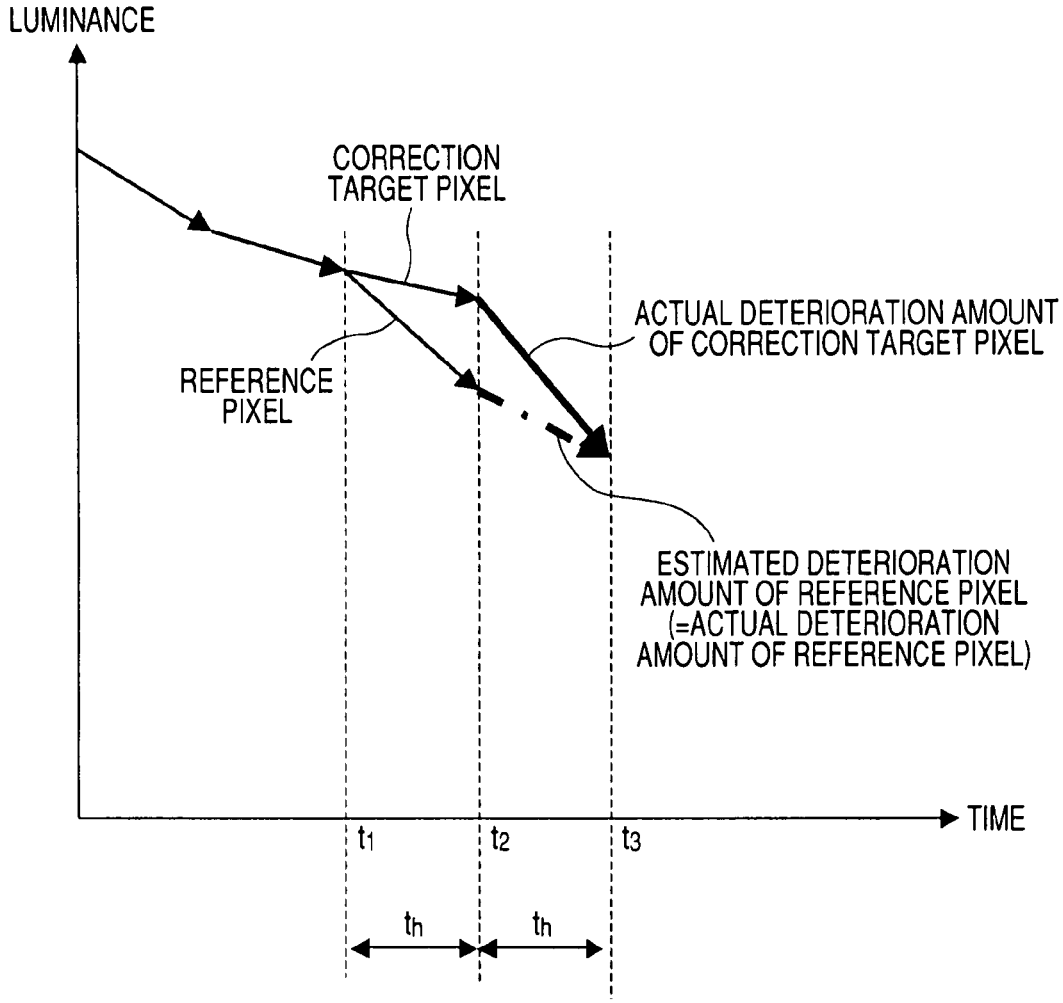
FIG. 11 is a diagram for explaining the transition of a deterioration amount caused when the estimation error correction is performed.

FIG. 11 shows a transition of the deterioration amount in the case of adopting the estimation error correction operation.

A-4. Advantages of the Configuration Example

As described above, in the case with the organic EL display explained in the present configuration example, since the deterioration amount of each pixel is measured using the deterioration rate as the parameter reflecting the drop of the emission luminance, it becomes possible to measure the deterioration amount in the emission characteristics more accurately in comparison with the related art to accurately determine the correction amount.

Additionally, there is adopted the method of performing the gamma conversion on the gradation value of the whole screen so as to eliminate the error in the deterioration amount of the reference pixel caused by the difference between the estimated video content and the actual video content, namely the error in the average luminance.

Therefore, the premise conditions in the estimated correction can surely be satisfied, and thus an accurate burn-in correction operation can be performed continuously.

In other words, there is realized a burn-in correction technology capable of making the emission luminance of the correction target pixel come close to the emission luminance of the reference pixel, even in the case in which the deterioration of the emission performance is not caused in proportion to the display gradation, and also surely eliminating any errors caused between the estimated deterioration amount and the actual deterioration amount.

It should be noted that the process of the estimation error correction section 33 can be realized by simple signal processing. Therefore, even if the size of the screen is enlarged, the difficulty level of manufacturing the display panel does not increase, and an increase in cost is hardly caused. As described above, it is advantageous in the manufacturing technology.

B. Other Configuration Examples a. In the configuration example described above, the case in which the deterioration amount difference of each pixel and the average gradation value of the whole screen are calculated for every luminescent color is explained.

However, the configuration example also can be applied to the case in which the gradation value for every luminescent color is converted into the gradation value on the gray-scale, and the deterioration amount difference corresponding to the gradation value on the gray-scale and the average gradation value of the whole screen are calculated.

b. In the configuration example described above, the case in which only one gradation value/deterioration amount conversion table is prepared to achieve the mutual conversion between the deterioration amount (rate) and the gradation value is explained.

However, if there is a possibility that the gradation value and the deterioration rate (amount) varies with time in consequence of a use environment or material characteristics, a method of selectively using a plurality of kinds of gradation value/deterioration amount conversion tables optimum for respective conditions can be adopted. In this case, it is possible to provide sensing devices, such as a temperature sensor or a service period timer, and switch the gradation value/deterioration amount conversion table to be referred to in each of the processing sections in accordance with the detection results.

c. In the configuration example described above, the case in which only one gradation value/deterioration amount conversion table is prepared to achieve the mutual conversion between the deterioration amount (rate) and the gradation value is explained.

However, it is also possible to adopt a mechanism for disposing a dummy pixel for detecting the over-time change in the emission characteristic of the organic EL elements inside the display panel and correcting the input-output relation by detecting the over-time change in the emission characteristic through the luminance detection sensor.

For example, it is possible to adopt a method of detecting the deterioration rate of the whole or apart of the gradation values and calculating the deterioration rate (amount) corresponding to each of the gradation values in accordance with the detection result.

d. In the configuration example described above, there is explained the case of preparing the conversion table having the gamma curves (input-output relations) corresponding to the error amount between the estimated deterioration amount and the actual deterioration amount.

However, it is also possible to adopt a mechanism in which the input-output relations are obtained by calculation and updated.

e. In the configuration example described above, there is explained the case in which an input-output relation capable of eliminating a larger error amount than in the case of eliminating the actual error amount is made to correspond thereto as the conversion table having the gamma curves (input-output relations) corresponding to the error amount between the estimated deterioration amount and the actual deterioration amount.

However, it is also possible to make the input-output relation necessary to eliminate the actual error amount correspond thereto in accordance with the principle.

f. In the configuration example described above, there is explained the case with the three fundamental colors of R, G, and B. However, it can be adopted to the case with four or more fundamental colors, including the complementary colors. In this case, it is sufficient to provide only the same number of dummy pixels as the number of fundamental colors.

g. In the configuration example described above, although the configuration of color formation of the fundamental colors is not explained, it is possible to provide organic EL elements having different light-emitting materials for respective fundamental colors, or to form the fundamental colors using the color filter method or the color conversion method.

h. Although in the configuration example described above the organic EL display panel is exemplified as an example of the light-emitting display device, it can be applied to other light-emitting display devices. For example, it can be applied to a field emission display (FED), an inorganic EL display panel, an LED panel, or others.

i. In the configuration example described above, there is explained the case in which the gradation value is converted into the deterioration amount parameter to determine the burn-in correction amount so that the difference in the deterioration amount from the reference pixel is eliminated as the estimation method of the burn-in correction amount.

However, any methods including processing technologies known to the public can be adopted as the calculation process of the burn-in correction amount.

j. In the configuration example described above, there is explained the case in which the video signal supplied to the organic EL panel module 5 is fed back to the gradation value/deterioration amount conversion section 311 to calculate the deterioration amount corresponding to each of the correction target pixels.

However, it is also possible to provide the video signal to be input to the estimated correction section 31 or the video signal corrected by the deterioration amount difference correction section 319 to the gradation value/deterioration amount conversion section 311 to calculate the deterioration amount.

k. In the configuration example described above, there is explained the case in which the pixel emitting light with the average luminance value of all of the pixels forming the effective display area is adopted as the reference pixel.

However, the reference pixel which becomes the target of convergence of the deterioration amount is not limited to the average luminance value. For example, it is also possible to adopt a method of using the pixel having the smallest deterioration amount accumulated for every pixel or the pixel having the greatest deterioration amount as the reference pixel. What pixel or gradation value is used as the reference value in determining the correction amount is dependent on the implemented system.

l. In the configuration example described above, the case in which the burn-in correction section 3 is implemented in the organic EL display 1 is explained.

However, the burn-in correction section 3 can be implemented in various electronic apparatuses mounting or controlling the light-emitting display device.

For example, the burn-in correction section 3 can be implemented in a computer, a printing device, a video camera, a digital camera, a game machine, a portable information terminal (e.g., a portable computer, a mobile phone, a portable game console, a electronic book), a watch, a clock, or a video player (e.g., an optical disc drive, a home server).

It should be noted that in either electronic apparatus, a housing, a signal processing section (MPU), and an external interface are provided as common components, and a peripheral device corresponding to the form of the product is combined therewith to configure the electronic apparatus.

Figure 12A:
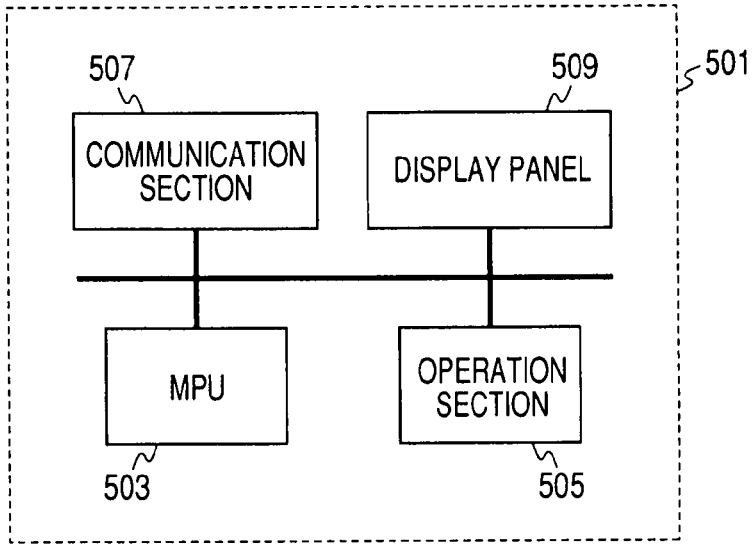
FIGS. 12A and 12B are diagrams for explaining examples of applications to other electronic apparatuses.

For example, in the case of the electronic apparatus having a communication function such as a mobile phone, a transmitting and receiving circuit and an antenna are provided in addition to the common components described above. FIG. 12A shows an example of a schematic configuration of such an electronic apparatus. In the case of the example, an electronic apparatus 501 is composed of a signal processing section 503, an operation section 505, a communication section 507, and a display panel 509.

Figure 12B:
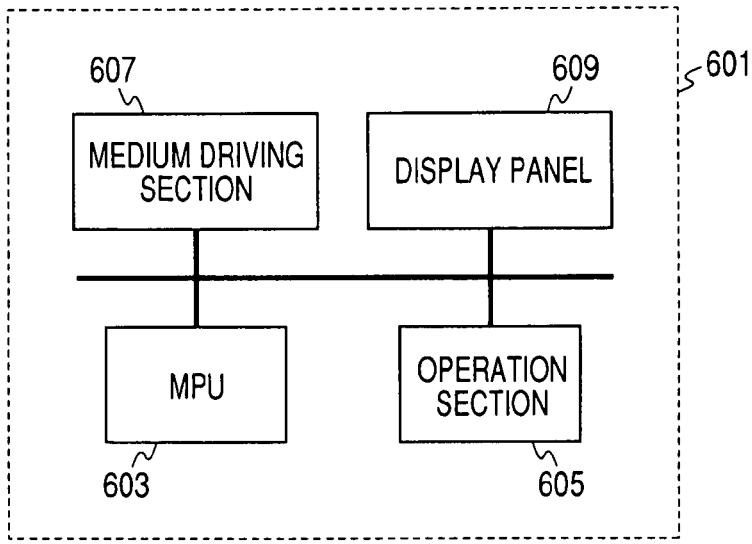

Further, for example, in the case with the electronic apparatus having a storage medium such as a game machine or a electronic book, a drive circuit for the storage medium is provided in addition to the configuration described above. FIG. 12B shows an example of a schematic configuration of such an electronic apparatus. In the case of the example, an electronic apparatus 601 is composed of a signal processing section 603, an operation section 605, a medium driving section 607, and a display panel 609.

Figure 13A:
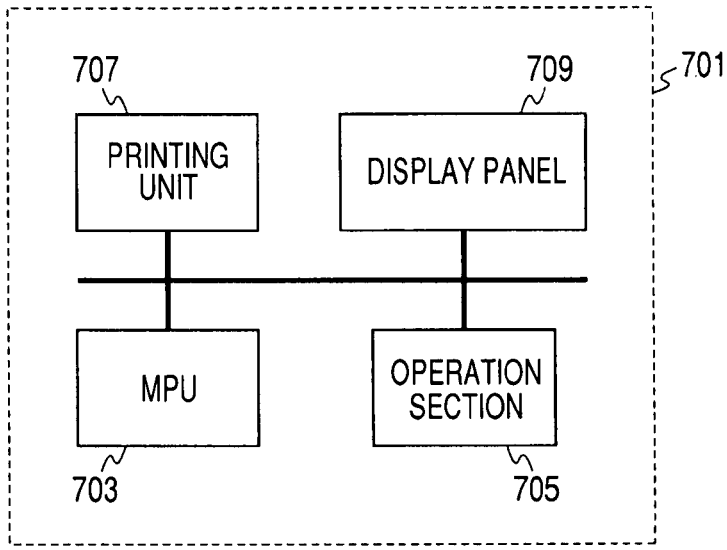
FIGS. 13A and 13B are diagrams for explaining examples of applications to other electronic apparatuses.

Further, for example, in the case with the printing device, a printing unit is provided in addition to the configuration described above. The most suitable printing unit is implemented in accordance with the printing method. As the printing method, for example, a laser method and an inkjet method can be cited. FIG. 13A shows an example of a schematic configuration of such an electronic apparatus. In the case of the example, an electronic apparatus 701 is composed of a signal processing section 703, an operation section 705, a printing unit 707, and a display panel 709.

Figure 13B:
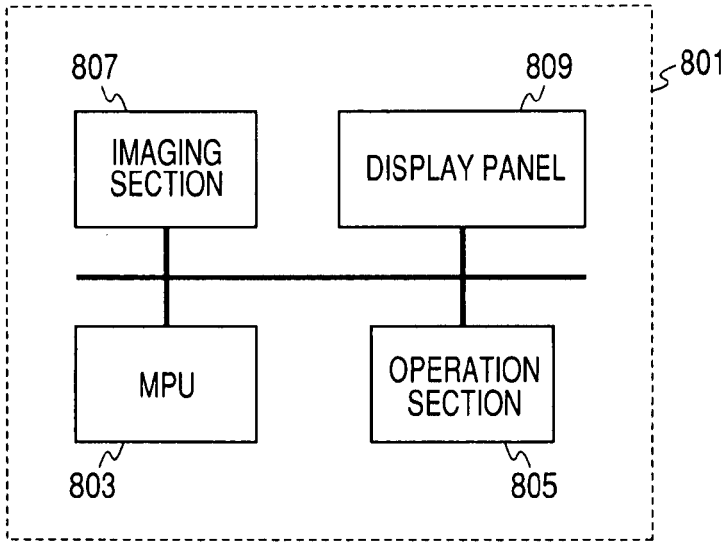

Further, for example, in the case with the video camera or the digital camera, a camera unit and a writing circuit for storing shot image data in a storage medium are implemented in addition to the configuration described above. FIG. 13B shows an example of a schematic configuration of such an electronic apparatus. In the case of the example, an electronic apparatus 801 is composed of a signal processing section 803, an operation section 805, an imaging section 807, and a display panel 809.

m. In the configuration example described above, although the burn-in correction function is explained from a viewpoint of a function, an equivalent function can obviously be realized as hardware and as software.

Further, the example is not limited to realizing the whole function by either hardware or software, but it is possible to realize only a part of the function by either hardware or software. In other words, it can be configured with a combination of hardware and software.

n. Various modified examples can be considered based on the configuration example described above within the scope of the invention. Further, various modified examples and application examples that are created based on the description of the present specification also can be considered.

What is claimed is:

1. A light-emitting display device comprising:

a display panel having a plurality of light-emitting elements disposed on a substrate in a matrix;

a deterioration amount difference calculation section for calculating a deterioration amount difference caused between a correction target pixel and a reference pixel in a first light-emitting period;

a correction amount calculation section for calculating a correction amount necessary to eliminate the calculated deterioration amount difference in a second light-emitting period for each correction target pixel in accordance with an estimated deterioration amount of the reference pixel;

a deterioration amount difference correction section for correcting a gradation value of a corresponding pixel with the calculated correction amount;

a gamma conversion section for performing a gamma conversion on the gradation value corrected by the deterioration amount difference correction section to supply the display panel with the gradation value;

an actual deterioration amount calculation section for inputting the gradation value supplied from the gamma conversion section to the display panel to calculate an actual deterioration amount corresponding to the reference pixel;

an estimation error detection section for detecting an error amount between the estimated deterioration amount and the actual deterioration amount calculated with respect to the reference pixel to update an input-output relation used by the gamma conversion section so as to eliminate the error amount; and an estimated correction operation section for performing an estimated correction operation by alternately repeating an accumulation of an estimated deterioration amount difference between the pixels and correcting the accumulated deterioration amount difference.

2. The light-emitting display device according to claim 1, wherein the estimation error detection section includes a group of conversion tables including input-output relations corresponding to the error amount, and retrieves the conversion table corresponding to the detected error amount to update the input-output relation of the gamma conversion section.

3. The light-emitting display device according to claim 1, wherein the reference pixel is a pixel emitting light having an average gradation value of all the pixels forming an effective display area.

4. The light-emitting display device according to claim 1, wherein the reference pixel is set for every group of the light-emitting elements for emitting the light of the same color.

5. The light-emitting display device according to claim 1, wherein the deterioration amount corresponding to each of the gradation values is provided as a value obtained by converting an amount of drop of the luminance actually measured when the emission of the light with the gradation value continues for a predetermined period of time into a value per every unit time.

6. The light-emitting display device according to claim 1, wherein the correction amount calculation section obtains the deterioration amount difference Y caused between the correction target pixel and the reference pixel in a first light-emitting period t1 as $$Y=(\alpha 1-\alpha 2)\cdot t1$$

using a deterioration rate $\alpha$1 of the correction target pixel and the deterioration rate $\alpha$2 of the reference pixel caused in the first light-emitting period, and obtains a deterioration rate $\beta$1 of the correction target pixel necessary to eliminate the deterioration amount difference Y in a second light-emitting period t2 as $$\beta 1=\beta 2-Y/t2$$

using a deterioration rate $\beta$2 of the reference pixel estimated in the second light-emitting period.

7. An electronic apparatus comprising:

a display panel having a plurality of light-emitting elements disposed on a substrate in a matrix;

a computer system;

a deterioration amount difference calculation section for calculating a deterioration amount difference caused between a correction target pixel and a reference pixel in a first light-emitting period;

a correction amount calculation section for calculating a correction amount necessary to eliminate the calculated deterioration amount difference in a second light-emitting period for each correction target pixel in accordance with an estimated deterioration amount of the reference pixel;

a deterioration amount difference correction section for correcting a gradation value of a corresponding pixel with the calculated correction amount;

a gamma conversion section for performing a gamma conversion on the gradation value corrected by the deterioration amount difference correction section to supply the display panel with the gradation value;

an actual deterioration amount calculation section for inputting the gradation value supplied from the gamma conversion section to the display panel to calculate an actual deterioration amount corresponding to the reference pixel;

an estimation error detection section for detecting an error amount between the estimated deterioration amount and the actual deterioration amount calculated with respect to the reference pixel to update an input-output relation used by the gamma conversion section so as to eliminate the error amount; and an estimated correction operation section for performing an estimated correction operation by alternately repeating an accumulation of an estimated deterioration amount difference between the pixels and correcting the accumulated deterioration amount difference.

8. The electronic apparatus according to claim 7, wherein the electronic apparatus is a portable terminal device.

9. The electronic apparatus according to claim 7, wherein the electronic apparatus is a printing device implementing a printing unit.

10. The electronic apparatus according to claim 7, wherein the electronic apparatus is an imaging apparatus implementing an imaging device.

11. A burn-in correction device for correcting burn-in of a display panel having a plurality of light-emitting elements disposed on a substrate in a matrix, comprising:

a deterioration amount difference calculation section for calculating a deterioration amount difference caused between a correction target pixel and a reference pixel in a first light-emitting period;

a correction amount calculation section for calculating a correction amount necessary to eliminate the calculated deterioration amount difference in a second light-emitting period for each correction target pixel in accordance with an estimated deterioration amount of the reference pixel;

a deterioration amount difference correction section for correcting a gradation value of a corresponding pixel with the calculated correction amount;

a gamma conversion section for performing a gamma conversion on the gradation value corrected by the deterioration amount difference correction section to supply the display panel with the gradation value;

an actual deterioration amount calculation section for inputting the gradation value supplied from the gamma conversion section to the display panel to calculate an actual deterioration amount corresponding to the reference pixel;

an estimation error detection section for detecting an error amount between the estimated deterioration amount and the actual deterioration amount calculated with respect to the reference pixel to update an input-output relation used by the gamma conversion section so as to eliminate the error amount; and an estimated correction operation section for performing an estimated correction operation by alternately repeating an accumulation of an estimated deterioration amount difference between the pixels and correcting the accumulated deterioration amount difference.

12. A computer program product comprising a non-transitory computer readable medium including program code thereon to perform a process for correcting burn-in of a display panel having a plurality of light-emitting elements disposed on a substrate in a matrix, the program code being executable to perform operations comprising:

calculating a deterioration amount difference caused between a correction target pixel and a reference pixel in a first light-emitting period;

calculating a correction amount necessary to eliminate the calculated deterioration amount difference in a second light-emitting period for each correction target pixel in accordance with an estimated deterioration amount of the reference pixel;

correcting a gradation value of a corresponding pixel with the calculated correction amount;

performing a gamma conversion on the gradation value corrected by the deterioration amount difference correction section to supply the display panel with the gradation value;

inputting the gradation value supplied to the display panel to calculate an actual deterioration amount corresponding to the reference pixel;

detecting an error amount between the estimated deterioration amount and the actual deterioration amount calculated with respect to the reference pixel to update an input-output relation used by the gamma conversion step so as to eliminate the error amount; and performing an estimated correction operation by alternately repeating an accumulation of an estimated deterioration amount difference between the pixels and correcting the accumulated deterioration amount difference.

* * * * *